US009732559B2

(12) United States Patent
Bittar

(10) Patent No.: US 9,732,559 B2
(45) Date of Patent: Aug. 15, 2017

(54) EM-GUIDED DRILLING RELATIVE TO AN EXISTING BOREHOLE

(75) Inventor: Michael S. Bittar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 946 days.

(21) Appl. No.: 12/526,552

(22) PCT Filed: Jan. 18, 2008

(86) PCT No.: PCT/US2008/051447

§ 371 (c)(1),
(2), (4) Date: Sep. 26, 2010

(87) PCT Pub. No.: WO2009/091408

PCT Pub. Date: Jul. 23, 2009

(65) Prior Publication Data

US 2011/0006773 A1 Jan. 13, 2011

(51) Int. Cl.
*E21B 47/022* (2012.01)
*E21B 7/04* (2006.01)

(52) U.S. Cl.
CPC ..... *E21B 7/046* (2013.01); *E21B 47/02216* (2013.01)

(58) Field of Classification Search
CPC ..... E21B 47/02216; E21B 7/046
(Continued)

(56) References Cited

U.S. PATENT DOCUMENTS 2,901,689 A 8/1959 Barrett
3,014,177 A 12/1961 Hungerford et al.
(Continued)

FOREIGN PATENT DOCUMENTS

AU 2011202215 5/2013
AU 2011202518 5/2013
(Continued)

OTHER PUBLICATIONS

Bell, C. et al., "Navigating and Imaging in Complex Geology With Azimuthal Propagation Resistivity While Drilling", 2006 SPE Annual Technical Conference and Exhibition, SPE 102637, San Antonio, TX, USA, (Sep. 24, 2006), pp. 1-14.
Bittar, Michael S., "A New Azimuthal Deep-Reading Resistivity Tool for Geosteering and Advanced Formation Evaluation", 2007 SPE Annual Technical Conference and Exhibition, SPE 109971, Anaheim, CA, USA, (Nov. 11, 2007), pp. 1-9.
(Continued)

*Primary Examiner* — Taras P Bemko
(74) *Attorney, Agent, or Firm* — Iselin Law PLLC; Alan Bryson

(57) ABSTRACT

Parallel drilling systems and methods suitable for drilling wells for steam-assisted gravity drainage (SAGD). In some method embodiments, a tilted-antenna tool gathers azimuthally-sensitive electromagnetic signal measurements. Such measurements enable accurate measurement of inter-well distance and direction, thereby providing, the necessary information for drilling accurately-spaced wells having reduced vulnerability to "short-circuits" that inhibit effective reservoir exploitation. In some other method embodiments, a tilted-antenna tool transmits azimuthally non-uniform signals as it rotates. The attenuation and azimuthal variation detected by one or more receivers enables accurate direction and distance determination. The transmitter and receiver antennas can in some cases be combined into a single tool, while in other cases the transmitters and receivers are placed in separate wells to increase detection range.

24 Claims, 5 Drawing Sheets

(58) Field of Classification Search
USPC ..... 166/255.2; 175/62, 45; 324/333
See application file for complete search history.

(56) References Cited

U.S. PATENT DOCUMENTS

| | | | |
|---|---|---|---|
| 3,187,252 | A | 6/1965 | Hungerford |
| 3,286,163 | A | 11/1966 | Holser et al. |
| 3,406,766 | A | 10/1968 | Henderson |
| 3,412,815 | A | 11/1968 | Holser |
| 3,510,757 | A | 5/1970 | Huston |
| 3,539,911 | A | 11/1970 | Youmans et al. |
| 3,561,007 | A | 2/1971 | Gouilloud et al. |
| 3,614,600 | A | 10/1971 | Ronka et al. |
| 3,808,520 | A | 4/1974 | Runge |
| 3,982,176 | A | 9/1976 | Meador |
| 4,072,200 | A | 2/1978 | Morris et al. |
| 4,104,596 | A | 8/1978 | Smither |
| 4,209,747 | A | 6/1980 | Huchital |
| 4,224,989 | A | 9/1980 | Blount |
| 4,258,321 | A | 3/1981 | Neale |
| 4,297,699 | A | 10/1981 | Fowler et al. |
| 4,302,722 | A | 11/1981 | Gianzero |
| 4,319,191 | A | 3/1982 | Meador et al. |
| 4,360,777 | A | 11/1982 | Segesman |
| 4,430,653 | A | 2/1984 | Coon et al. |
| 4,443,762 | A | 4/1984 | Kuckes |
| 4,458,767 | A | 7/1984 | Hoehn, Jr. |
| 4,502,010 | A | 2/1985 | Kuckes |
| 4,504,833 | A | 3/1985 | Fowler et al. |
| 4,536,714 | A | 8/1985 | Clark |
| 4,553,097 | A | 11/1985 | Clark |
| 4,593,770 | A | 6/1986 | Hoehn, Jr. |
| 4,611,173 | A | 9/1986 | Bravenec et al. |
| 4,636,731 | A | 1/1987 | Savage et al. |
| 4,651,101 | A | 3/1987 | Barber et al. |
| 4,670,717 | A | 6/1987 | Sender |
| 4,697,190 | A | 9/1987 | Oswald |
| 4,700,142 | A | 10/1987 | Kuckes |
| 4,716,973 | A | 1/1988 | Cobern |
| 4,780,857 | A | 10/1988 | Lyle et al. |
| 4,785,247 | A | 11/1988 | Meador et al. |
| 4,791,373 | A | 12/1988 | Kuckes |
| 4,808,929 | A | 2/1989 | Oldigs |
| 4,810,970 | A | 3/1989 | Warren et al. |
| 4,814,768 | A | 3/1989 | Chang |
| RE32,913 | E | 4/1989 | Clark |
| 4,825,421 | A | 4/1989 | Jeter |
| 4,829,488 | A | 5/1989 | Siegfried, II |
| 4,845,434 | A | 7/1989 | Kuckes et al. |
| 4,873,488 | A | 10/1989 | Barber et al. |
| 4,875,014 | A | 10/1989 | Roberts et al. |
| 4,876,511 | A | 10/1989 | Clark |
| 4,899,112 | A | 2/1990 | Clark et al. |
| 4,909,336 | A | 3/1990 | Brown et al. |
| 4,933,640 | A | 6/1990 | Kuckes |
| 4,940,943 | A | 7/1990 | Bartel et al. |
| 4,945,987 | A | 8/1990 | Wittrisch |
| 4,949,045 | A | 8/1990 | Clark et al. |
| 4,962,490 | A | 10/1990 | Lyle et al. |
| 4,968,940 | A | 11/1990 | Clark et al. |
| 4,980,643 | A | 12/1990 | Gianzero et al. |
| 5,113,192 | A | 5/1992 | Thomas |
| 5,115,198 | A | 5/1992 | Gianzero et al. |
| 5,133,418 | A | 7/1992 | Gibson et al. |
| 5,138,313 | A | 8/1992 | Barrington |
| 5,155,198 | A | 10/1992 | Keohan |
| 5,200,705 | A | 4/1993 | Clark et al. |
| 5,210,495 | A | 5/1993 | Hapashy et al. |
| 5,230,386 | A | 7/1993 | Wu et al. |
| 5,230,387 | A | 7/1993 | Waters et al. |
| 5,241,273 | A | 8/1993 | Luling |
| 5,243,290 | A | 9/1993 | Safinya |
| 5,248,975 | A | 9/1993 | Schutz |
| 5,260,662 | A | 11/1993 | Rorden |
| 5,278,507 | A | 1/1994 | Bartel et al. |
| 5,318,123 | A | 6/1994 | Venditto et al. |
| 5,329,448 | A | 7/1994 | Rosthal |
| 5,332,048 | A | 7/1994 | Underwood et al. |
| 5,343,152 | A | 8/1994 | Kuckes |
| 5,355,088 | A | 10/1994 | Howard, Jr. |
| 5,357,253 | A | 10/1994 | Van Etten et al. |
| 5,358,050 | A | 10/1994 | Schmidt |
| 5,377,104 | A | 12/1994 | Sorrells et al. |
| 5,389,881 | A | 2/1995 | Bittar et al. |
| 5,400,030 | A | 3/1995 | Duren et al. |
| 5,402,068 | A | 3/1995 | Meador et al. |
| 5,420,589 | A | 5/1995 | Wells et al. |
| 5,428,293 | A | 6/1995 | Sinclair et al. |
| 5,485,089 | A | 1/1996 | Kuckes |
| 5,503,225 | A | 4/1996 | Withers |
| 5,508,616 | A | 4/1996 | Sato et al. |
| 5,530,358 | A | 6/1996 | Wisler et al. |
| 5,530,359 | A | 6/1996 | Habashy et al. |
| 5,541,517 | A | 7/1996 | Hartmann |
| 5,550,473 | A | 8/1996 | Klein |
| 5,552,786 | A | 9/1996 | Xia et al. |
| 5,563,512 | A | 10/1996 | Mumby |
| 5,585,790 | A | 12/1996 | Luling |
| 5,589,775 | A | 12/1996 | Kuckes |
| 5,594,343 | A | 1/1997 | Clark et al. |
| 5,631,562 | A | 5/1997 | Cram et al. |
| 5,656,930 | A | 8/1997 | Hagiwara |
| 5,676,212 | A | 10/1997 | Kuckes |
| 5,720,355 | A | 2/1998 | Lamine et al. |
| 5,725,059 | A | 3/1998 | Kuckes et al. |
| 5,747,750 | A | 5/1998 | Bailey et al. |
| 5,757,191 | A | 5/1998 | Gianzero |
| 5,765,642 | A | 6/1998 | Surjaatmadja |
| 5,781,436 | A | 7/1998 | Forgang et al. |
| 5,854,991 | A | 12/1998 | Gupta et al. |
| 5,869,968 | A | 2/1999 | Brooks et al. |
| 5,886,526 | A | 3/1999 | Wu |
| 5,892,460 | A | 4/1999 | Jerabek et al. |
| 5,900,833 | A | 5/1999 | Sunlin et al. |
| 5,917,160 | A | 6/1999 | Bailey |
| 5,923,170 | A | 7/1999 | Kuckes |
| 6,044,325 | A | 3/2000 | Chakravarthy et al. |
| 6,084,826 | A | 7/2000 | Leggett, III |
| 6,098,727 | A | 8/2000 | Ringgenberg et al. |
| 6,100,839 | A | 8/2000 | Heger et al. |
| 6,147,496 | A | 11/2000 | Strack et al. |
| 6,163,155 | A | 12/2000 | Bittar |
| 6,181,138 | B1 | 1/2001 | Hagiwara et al. |
| 6,191,586 | B1 | 2/2001 | Bittar |
| 6,191,588 | B1 | 2/2001 | Chen |
| 6,206,108 | B1 | 3/2001 | MacDonald et al. |
| 6,216,783 | B1 | 4/2001 | Hocking et al. |
| 6,218,841 | B1 | 4/2001 | Wu |
| 6,218,842 | B1 | 4/2001 | Bittar |
| 6,257,334 | B1 | 7/2001 | Cyr |
| 6,297,639 | B1 | 10/2001 | Clark et al. |
| 6,304,086 | B1 | 10/2001 | Minerbo et al. |
| 6,351,127 | B1 | 2/2002 | Rosthal et al. |
| 6,353,321 | B1 | 3/2002 | Bittar |
| 6,359,438 | B1 | 3/2002 | Bittar |
| 6,373,254 | B1 | 4/2002 | Dion et al. |
| 6,389,438 | B1 | 5/2002 | Zhou |
| 6,435,286 | B1 | 8/2002 | Stump et al. |
| 6,460,936 | B1 | 10/2002 | Abramov et al. |
| 6,466,020 | B2 | 10/2002 | Kuckes et al. |
| 6,476,609 | B1 | 11/2002 | Bittar |
| 6,496,137 | B1 | 12/2002 | Johansson |
| 6,508,316 | B2 | 1/2003 | Estes et al. |
| 6,538,447 | B2 | 3/2003 | Bittar |
| 6,541,979 | B2 | 4/2003 | Omeragic |
| 6,556,014 | B1 | 4/2003 | Kong et al. |
| 6,566,881 | B2 | 5/2003 | Omeragic et al. |
| 6,573,722 | B2 | 6/2003 | Rosthal et al. |
| 6,584,408 | B2 | 6/2003 | Omeragic |
| 6,614,229 | B1 | 9/2003 | Clark et al. |
| 6,630,831 | B2 | 10/2003 | Amini |
| 6,633,252 | B2 | 10/2003 | Stolarczyk et al. |
| 6,646,441 | B2 | 11/2003 | Thompson et al. |
| 6,651,739 | B2 | 11/2003 | Arndt et al. |

(56) References Cited

U.S. PATENT DOCUMENTS 6,672,409 B1 1/2004 Dock et al.
6,693,430 B2 2/2004 Rosthal et al.
6,710,600 B1 3/2004 Kopecki et al.
6,712,140 B2 3/2004 van Oers et al.
6,727,706 B2 4/2004 Gao et al.
6,736,222 B2 5/2004 Kuckes et al.
6,755,263 B2 6/2004 Alft et al.
6,765,385 B2 7/2004 Sinclair et al.
6,771,206 B2 8/2004 Berthelier et al.
6,777,940 B2 8/2004 Macune
6,778,127 B2 8/2004 Stolarczyk et al.
6,788,065 B1 9/2004 Homan et al.
6,810,331 B2 10/2004 Bittar et al.
6,856,132 B2 2/2005 Appel
6,863,127 B2 3/2005 Clark et al.
6,885,943 B2 4/2005 Bittar et al.
6,900,640 B2 5/2005 Fanini et al.
6,925,031 B2 8/2005 Kriegshauser et al.
6,940,446 B2 9/2005 Cist
6,944,546 B2 9/2005 Xiao et al.
6,958,610 B2 10/2005 Gianzero
6,961,663 B2 11/2005 Sinclair et al.
6,985,814 B2 1/2006 McElhinney
6,998,844 B2 2/2006 Omeragic et al.
7,013,991 B2 3/2006 Wilson-Langman et al.
7,019,528 B2 3/2006 Bittar
7,038,455 B2 5/2006 Beste et al.
7,046,009 B2 5/2006 Itskovich
7,091,877 B2 8/2006 Barber et al.
7,098,664 B2 8/2006 Bittar et al.
7,098,858 B2 8/2006 Bittar et al.
7,123,016 B2 10/2006 Larsen
7,143,844 B2 12/2006 Alft et al.
7,171,310 B2 1/2007 Haugland
7,202,670 B2 4/2007 Omeragic et al.
7,227,363 B2 6/2007 Gianzero et al.
7,268,019 B2 9/2007 Golla et al.
7,296,462 B2 11/2007 Gregory et al.
7,301,223 B2 11/2007 Rodney et al.
7,336,222 B2 2/2008 Praskovsky et al.
7,345,487 B2 3/2008 Bittar et al.
7,350,568 B2 4/2008 Mandal et al.
7,425,830 B2 9/2008 Banning et al.
7,425,831 B2 9/2008 Banning et al.
7,427,862 B2 9/2008 Dashevsky et al.
7,427,863 B2 9/2008 Bittar
7,477,162 B2 1/2009 Clark
7,536,261 B2 5/2009 Omeragic et al.
7,557,579 B2 7/2009 Bittar
7,557,580 B2 7/2009 Bittar
7,612,565 B2 11/2009 Seydoux et al.
7,657,377 B2 2/2010 Sinclair et al.
7,659,722 B2 2/2010 Bittar
7,686,099 B2 3/2010 Rodney
7,746,078 B2 6/2010 Bittar et al.
7,775,276 B2 8/2010 Pelletier et al.
7,786,733 B2 8/2010 Seydoux et al.
7,825,664 B2 11/2010 Homan et al.
7,839,148 B2 11/2010 Vehra et al.
7,839,346 B2 11/2010 Bittar et al.
7,848,887 B2 12/2010 Yang et al.
7,912,648 B2 3/2011 Tang et al.
7,924,013 B2 4/2011 Seydoux et al.
7,948,238 B2 5/2011 Bittar
7,982,464 B2 7/2011 Bittar et al.
8,016,053 B2 9/2011 Menezes et al.
8,026,722 B2 9/2011 McElhinney
8,030,937 B2 10/2011 Hu et al.
8,085,049 B2 12/2011 Bittar et al.
8,085,050 B2 12/2011 Bittar et al.
8,159,227 B2 4/2012 Wang
8,174,265 B2 5/2012 Bittar et al.
8,222,902 B2 7/2012 Bittar et al.
8,264,228 B2 9/2012 Bittar et al.
8,274,289 B2 9/2012 Bittar et al.
8,433,518 B2 4/2013 Omeragic et al.
8,499,830 B2 8/2013 Alberty
8,593,147 B2 11/2013 Bittar
8,736,270 B2 5/2014 Seydoux et al.
9,157,315 B2 10/2015 Bittar et al.
9,310,508 B2 4/2016 Donderici et al.
9,329,298 B2 5/2016 Bittar et al.
9,465,132 B2 10/2016 Bittar
2001/0022238 A1 9/2001 Houwelingen et al.
2001/0022464 A1 9/2001 Seear
2002/0101242 A1 8/2002 Bittar
2003/0018433 A1 1/2003 Blanch et al.
2003/0023381 A1 1/2003 San Martin
2003/0051914 A1 3/2003 Bittar
2003/0055565 A1 3/2003 Omeragic
2003/0056983 A1 3/2003 Alft et al.
2003/0076107 A1 4/2003 Fanini et al.
2003/0090424 A1 5/2003 Brune et al.
2003/0184302 A1 10/2003 Omeragic et al.
2003/0223620 A1 12/2003 Anxionnaz et al.
2003/0229449 A1 12/2003 Merchant et al.
2003/0229450 A1 12/2003 Strickland
2004/0019427 A1 1/2004 San Martin et al.
2004/0027131 A1 2/2004 Bittar
2004/0056816 A1 3/2004 Bittar et al.
2004/0059513 A1 3/2004 Bittar et al.
2004/0059514 A1 3/2004 Bittar et al.
2004/0060708 A1 4/2004 Clark et al.
2004/0061622 A1 4/2004 Clark
2004/0140809 A1 7/2004 Mercer
2004/0145503 A1 7/2004 Blanch et al.
2004/0183538 A1 9/2004 Hanstein et al.
2004/0196047 A1 10/2004 Fanini et al.
2005/0006090 A1 1/2005 Chemali et al.
2005/0024060 A1 2/2005 Bittar
2005/0075789 A1 4/2005 Xiao et al.
2005/0083063 A1 4/2005 Omeragic et al.
2005/0099184 A1 5/2005 Gianzero et al.
2005/0134279 A1 6/2005 Hu et al.
2005/0134280 A1 6/2005 Bittar et al.
2005/0140373 A1 6/2005 Li et al.
2005/0150692 A1 7/2005 Ballantyne et al.
2005/0211469 A1 9/2005 Kuckes et al.
2005/0218898 A1 10/2005 Fredette et al.
2005/0230107 A1 10/2005 McDaniel et al.
2005/0251342 A1 11/2005 Market et al.
2006/0011385 A1 1/2006 Seydoux et al.
2006/0015256 A1 1/2006 Hassan et al.
2006/0022887 A1 2/2006 Bittar
2006/0033502 A1 2/2006 Bittar
2006/0038571 A1 2/2006 Ostermeier et al.
2006/0054354 A1 3/2006 Orban
2006/0061364 A1 3/2006 Banning et al.
2006/0102353 A1 5/2006 Storm et al.
2006/0125479 A1 6/2006 Chemali et al.
2006/0157277 A1 7/2006 Bittar et al.
2006/0173624 A1 8/2006 Frenkel
2006/0175057 A1 8/2006 Mandal et al.
2006/0244455 A1 11/2006 Bittar
2006/0255811 A1 11/2006 Bittar et al.
2007/0079989 A1 4/2007 Bankston et al.
2007/0126426 A1 6/2007 Clark et al.
2007/0137854 A1 6/2007 Homan et al.
2007/0205021 A1 9/2007 Pelletier et al.
2007/0229082 A1 10/2007 Vehra et al.
2007/0235225 A1 10/2007 Bittar
2007/0278008 A1 12/2007 Kuckes et al.
2008/0000686 A1 1/2008 Kuckes et al.
2008/0018895 A1 1/2008 Opsal
2008/0078580 A1 4/2008 Bittar
2008/0136419 A1 6/2008 Seydoux et al.
2008/0143336 A1 6/2008 Legendre
2008/0173481 A1 7/2008 Menezes et al.
2008/0224707 A1 9/2008 Wisler et al.
2008/0252296 A1 10/2008 Hu et al.
2008/0258733 A1 10/2008 Bittar
2008/0278169 A1 11/2008 Bittar
2008/0315884 A1 12/2008 Bittar et al.
2009/0015260 A1 1/2009 Bittar

(56) References Cited

U.S. PATENT DOCUMENTS

| | | | |
|---|---|---|---|
| 2009/0045973 | A1 | 2/2009 | Rodney et al. |
| 2009/0164127 | A1 | 6/2009 | Clark |
| 2009/0224764 | A1 | 9/2009 | Bittar |
| 2009/0229826 | A1 | 9/2009 | East, Jr. et al. |
| 2009/0230968 | A1 | 9/2009 | Bittar et al. |
| 2009/0277630 | A1 | 11/2009 | McDaniel et al. |
| 2009/0278543 | A1 | 11/2009 | Beste et al. |
| 2009/0302851 | A1 | 12/2009 | Bittar et al. |
| 2009/0309600 | A1 | 12/2009 | Seydoux et al. |
| 2009/0309798 | A1 | 12/2009 | Bittar et al. |
| 2009/0315563 | A1 | 12/2009 | Fox et al. |
| 2010/0004866 | A1 | 1/2010 | Rabinovich et al. |
| 2010/0012377 | A1 | 1/2010 | Sharp et al. |
| 2010/0117655 | A1 | 5/2010 | Bittar |
| 2010/0123462 | A1 | 5/2010 | Bittar |
| 2010/0127708 | A1 | 5/2010 | Bittar |
| 2010/0134111 | A1 | 6/2010 | Itskovich |
| 2010/0156424 | A1 | 6/2010 | Bittar et al. |
| 2010/0176812 | A1 | 7/2010 | Bittar et al. |
| 2010/0262370 | A1 | 10/2010 | Bittar et al. |
| 2010/0284250 | A1 | 11/2010 | Cornish et al. |
| 2011/0006773 | A1 | 1/2011 | Bittar |
| 2011/0019501 | A1 | 1/2011 | Market |
| 2011/0175899 | A1 | 7/2011 | Bittar et al. |
| 2011/0180327 | A1 | 7/2011 | Bittar et al. |
| 2011/0186290 | A1 | 8/2011 | Roddy et al. |
| 2011/0187556 | A1 | 8/2011 | Roddy et al. |
| 2011/0192592 | A1 | 8/2011 | Roddy et al. |
| 2011/0199228 | A1 | 8/2011 | Roddy et al. |
| 2011/0221443 | A1 | 9/2011 | Bittar et al. |
| 2011/0234230 | A1 | 9/2011 | Bittar et al. |
| 2011/0251794 | A1 | 10/2011 | Bittar et al. |
| 2011/0298461 | A1 | 12/2011 | Bittar et al. |
| 2011/0308794 | A1 | 12/2011 | Bittar et al. |
| 2011/0308859 | A1 | 12/2011 | Bittar et al. |
| 2011/0309833 | A1 | 12/2011 | Yang |
| 2011/0309835 | A1 | 12/2011 | Barber et al. |
| 2011/0309836 | A1 | 12/2011 | Bittar et al. |
| 2012/0001637 | A1 | 1/2012 | Bittar et al. |
| 2012/0024600 | A1 | 2/2012 | Bittar et al. |
| 2012/0025834 | A1 | 2/2012 | Minerbo et al. |
| 2012/0133367 | A1 | 5/2012 | Bittar et al. |
| 2012/0249149 | A1 | 10/2012 | Bittar et al. |
| 2012/0283951 | A1 | 11/2012 | Li et al. |
| 2012/0283952 | A1 | 11/2012 | Tang et al. |
| 2012/0306500 | A1 | 12/2012 | Bittar et al. |
| 2013/0105224 | A1 | 5/2013 | Donderici et al. |
| 2014/0032116 | A1 | 1/2014 | Guner et al. |
| 2016/0033669 | A1 | 2/2016 | Bittar et al. |
| 2016/0370490 | A1 | 12/2016 | Bittar |

FOREIGN PATENT DOCUMENTS

| | | | |
|---|---|---|---|
| CA | 2415563 | | 1/2002 |
| EP | 527089 | | 2/1993 |
| EP | 0553908 | | 4/1993 |
| EP | 0556114 | | 8/1993 |
| EP | 0654687 | | 5/1995 |
| EP | 0814349 | A2 | 12/1997 |
| EP | WO9800733 | | 1/1998 |
| EP | 0840142 | A2 | 5/1998 |
| EP | 093519 | | 7/1999 |
| EP | WO0155748 | | 8/2001 |
| FR | 2561395 | | 9/1985 |
| FR | 2 699 286 | | 6/1994 |
| GB | 1363079 | A | 8/1974 |
| GB | 2030414 | | 4/1980 |
| GB | 2 279 149 | | 12/1994 |
| GB | 2279149 | | 12/1994 |
| GB | 2352259 | | 1/2001 |
| GB | 2441033 | | 2/2008 |
| GB | 2468734 | B | 8/2012 |
| JP | 4001392 | | 1/1992 |
| JP | 8094737 | A | 4/1996 |
| RU | 2043656 | | 9/1995 |
| RU | 2107313 | | 3/1998 |
| RU | 2279697 | | 10/2003 |
| RU | 2305300 | | 8/2007 |
| WO | WO9531736 | | 11/1995 |
| WO | WO-98/00733 | | 1/1998 |
| WO | WO-98/45733 | | 10/1998 |
| WO | WO-0000852 | | 1/2000 |
| WO | WO00/41006 | | 7/2000 |
| WO | WO0050926 | | 8/2000 |
| WO | WO-0148353 | | 7/2001 |
| WO | WO-02/04986 | | 1/2002 |
| WO | WO03/069120 | | 8/2003 |
| WO | WO-03080988 | | 10/2003 |
| WO | WO-2006/011927 | | 2/2006 |
| WO | WO-2006079154 | | 8/2006 |
| WO | WO-2006/030489 | | 12/2007 |
| WO | WO-2007/145859 | | 12/2007 |
| WO | WO-2007/149106 | | 12/2007 |
| WO | WO-2008/008346 | | 1/2008 |
| WO | WO-2008/008386 | | 1/2008 |
| WO | WO2008/021868 | | 2/2008 |
| WO | WO-2008036077 | | 3/2008 |
| WO | WO-2008/076130 | | 6/2008 |
| WO | WO-2008/115229 | | 9/2008 |
| WO | WO-2008/154679 | | 12/2008 |
| WO | WO-2009014882 | | 1/2009 |
| WO | WO-2009/073008 | | 6/2009 |
| WO | WO-2009091408 | | 7/2009 |
| WO | WO-2009/131584 | | 10/2009 |
| WO | WO-2010/005902 | | 1/2010 |
| WO | WO-2010/005907 | | 1/2010 |
| WO | WO-2010006302 | | 1/2010 |
| WO | WO-2010/065208 | | 6/2010 |
| WO | WO-2010075237 | | 7/2010 |
| WO | WO-2011049828 | | 4/2011 |
| WO | WO-2011-129828 | | 10/2011 |
| WO | WO2012/005737 | | 1/2012 |
| WO | WO-2012/005737 | | 1/2012 |
| WO | WO-2012/008965 | | 1/2012 |
| WO | WO-2012/064342 | | 5/2012 |
| WO | WO-2012/121697 | | 9/2012 |
| WO | WO-2012/144977 | | 10/2012 |
| WO | WO-2014/003702 | | 1/2014 |

OTHER PUBLICATIONS

Bittar, Michael S., "Processing Resistivity Logs", U.S. Appl. No. 60/821,721, filed Aug. 8, 2006.

Bittar, Michael S., "Resistivity Logging with Reduced Dip Artifacts", PCT Patent Appl US2007/075455, filed Aug. 8, 2006, 24 pgs.

Bittar, Michael S., et al., "A True Multiple Depth of Investigation Electromagnetic Wave Resistivity Sensor: Theory, Experiment, and Prototype Field Test Results", SPE 22705, 66th Annual Technical Conference and Exhibition of the SPE, Dallas, TX, (Oct. 6, 1991), pp. 1-8, plus 10 pgs of Figures.

Bittar, Michael S., et al., "Invasion Profiling with a Multiple Depth of Investigation, Electromagnetic Wave Resistivity Sensor", SPE 28425, 69th Annual Technical Conference and Exhibition of the SPE, New Orleans, LA, (Sep. 25, 1994),pp. 1-12, plus 11 pgs of Figures.

Bittar, Michael S., et al., "The Effects of Rock Anisotropy on MWD Electromagnetic Wave Resistivity Sensors", The Log Analyst, (Jan. 1996), pp. 20-30.

Bittar, Michael S., et al., "The Effects of Rock Anisotropy on MWD Electromagnetic Wave Resistivity Sensors", SPWLA 35th Annual Logging Symposium, (Jun. 19, 1994), 18 pgs.

Bonner, S. et al., "A New Generation of Electrode Resistivity Measurements for Formation Evaluation While Drilling", SPWLA 35th Annual Logging Symposium, (Jun. 19, 1994), pp. 1-19.

Clark, Brian et al., "A Dual Depth Resistivity Measurement for Fewd", SPWLA 29th Annual Logging Symposium, (Jun. 1988), 25 pgs.

Clark, Brian et al., "Electromagnetic Propagation Logging While Drilling: Theory and Experiment", SPE Formation Evaluation, (Sep. 1990), pp. 263-271.

Hagiwara, T. "A New Method to Determine Horizontal-Resistivity in Anisotropic Formations Without Prior Knowledge of Relative

(56) References Cited

OTHER PUBLICATIONS

Dip", 37th Annual SPWLA Logging Symposium, New Orleans, LA, (Jun. 16, 1996), pp. 1-5 , plus 3 pgs of Figs.
Li, Qiming et al., "New Directional Electromagnetic Tool for Proactive Geosteering and Accurate Formation Evaluation While Drilling", SPWLA 46th Annual Logging Symposium, New Orleans, LA, USA, (Jun. 26, 2005), pp. 1-16.
Luling, M. et al., "Processing and Modeling 2-MHz Resistivity Tools in Dipping, Laminated, Anisotropic Formations: SPWLA", SPWLA 35th Annual Logging Symposium, paper QQ, (1994), pp. 1-25.
Mack, S. G., et al., "MWD Tool Accurately Measures Four Resistivities", Oil & Gas Journal, (May 25, 1992), pgs. 1-5.
Mechetin, V. F., et al., "Temp—A New Dual Electromagnetic and Laterolog Apparatus—Technological Complex", All-Union Research Logging Institute, Ufa, USSR. Ch. Ostrander, Petro Physics Int'l, Dallas, Texas, USA, (Date Unkn), 17 pgs.
Meyer, W. H., "New Two Frequency Propagation Resistivity Tools", SPWLA 36th Annual Logging Symposium, (Jun. 26-29, 1995), 12 pgs.
Rodney, Paul F., et al., "Electromagnetic Wave Resistivity MWD Tool", SPE Drilling Engineering, (Oct. 1986), pp. 37-346.
Zhu, Tianfei et al., "Two Dimensional Velocity Inversion and Synthetic Seismogram Computation", Geophysics, vol. 52, No. 1, (Jan. 1987), pp. 37-49.
Alberty, Mark William "Method to Detect Casing Point in a Well from Resistivity Ahead of the Bit", App. No. PCT/US2010/0000729, (Jan. 7, 2010),14 pgs.
Bittar, Michael S., et al., "Multi-Step Borehole Correction Scheme for Multi-Component Induction Tool", U.S. Appl. No. 61/319,291, filed Mar. 31, 2010, 20 pgs.
PCT Application, dated Jun. 25, 2012, Appl No. PCT/US2012/043943, "Tilted Antenna Logging Systems and Methods Yielding Robust Measurement Signals", filed Jun. 25, 2012, 20 pgs.
PCT International Search Report and Written Opinion, dated Jul. 26, 2011, Appl No. PCT/US2011/032865, "Multicomponent Borehole Radar Systems and Methods", filed Apr. 18, 2011, 8 pgs.
PCT International Search Report and Written Opinion, dated Aug. 27, 2010, Appl No. PCT/US10/40447, "Method and Apparatus for Sensing Elongated Subterranean Anomalies", filed Jun. 29, 2010, 9 pgs.
US Patent Application, dated Jun. 25, 2012, Appl No. PCT/US2012/043937, "Resistivity Logging Systems and Methods Employing Ratio Signal Set for Inversion", filed Jun. 25, 2012, 17 pgs.
US Patent Application, dated Jun. 29, 2010, U.S. Appl. No. 13/521,769, "Method and Apparatus for Sensing Elongated Subterranean Anomalies", filed Jun. 29, 2010, 25 pgs.
Third Chinese Office Action, dated Mar. 18, 2013, Appl No. 200780026363.0, "Modular Geosteering Tool Assembly", filed Jul. 11, 2007, 12 pgs.
US Final Office Action, dated Apr. 2, 2013, U.S. Appl. No. 13/095,420, "Electromagnetic Wave Resistivity Tool Having a Tilted Antenna for Determining the Horizontal and Vertical Resistivities and Relative Dip Angle in Anisotropic Earth Formations", Filed Apr. 7, 2011, 32 pgs.
First Indian Examination Report, dated Apr. 12, 2013, Appl No. 1232/DELNP/2008, "Electromagnetic Resistivity Logging Systems and Logging Methods Relating Thereto", filed Dec. 15, 2006, 1 pg.
Chinese Decision on Rejection, dated May 6, 2013, Appl No. 200880007526.5, "EM-Gided Drilling Relative to an Existing Borehole", filed Jan. 18, 2008, 10 pgs.
In First Examination Report, dated Apr. 12, 2013, Appl No. 1232/DELNP/2008, "Electromagnetic Resistivity Logging Systems and Logging Methods Relating Thereto", filed Dec. 15, 2006.
CN Decision on Rejection, dated May 6, 2013, Appl No. 200880007526.5, "EM-Gided Drilling Relative to an Existing Borehole", filed Jan. 18, 2008, 10 pgs., (Sep. 8, 2009).
US Final Office Action, dated May 22, 2013, U.S. Appl. No. 12/689,435, "Tool for Azimuthal Resistivity Measurement and Bed Boundary Detection" filed Jan. 19, 2010, 8 pgs.
US Non-Final Office Action, dated Sep. 17, 2013, U.S. Appl. No. 12/689,435, Tool for Azimuthal Resistivity Measurement and Bed Boundary Detection, filed Jan. 19, 2010, 6 pgs.
US Final Office Action, dated Sep. 30, 2013, U.S. Appl. No. 13/095,420, "Electromagnetic Wave Resistivity Tool Having a Tilted Antenna for Determining the Horizontal and Vertical Resistivities and Relative Dip Angle in Anisotropic Earth Formations", filed Apr. 27, 2011, 31 pgs.
Moinfar, Ali et al., "Time-Lapse Variations of Multi-Component Electrical Resistivity Measurements Acquired in High-Angle Wells", Moinfar, Ali, et al., "Time-Lapse Variations of Multi-Component Electrical Resistivity. Measurements Acquired in High-Angle Wells," Petrophysics, Dec. 2010, pp. 408-427, vol. 51, No. 6, 20 pgs.
"U.S. Final Office Action", dated May 22, 2013, U.S. Appl. No. 12/689,435, "Tool for Azimuthal Resistivity Measurement and Bed Boundary Detection" filed Jan. 19, 2010, 8 pgs.
"Canadian Examiner's Letter", dated Jan. 16, 2014, Appl No. 2,800,148, "Method and Apparatus for Sensing Elongated Subterranean Anomalies", filed Jun. 29, 2010, 3 pgs.
"U.S. Final Office Action", dated May 20, 2014, U.S. Appl. No. 12/689,435, "Tool for Azimuthal Resistivity Measurement and Bed Boundary Detection," filed Jan. 19, 2010, 9.
"GB Office Action", dated Aug. 20, 2014, Appl. No. 09166567.9, " Estimating Casing Wear Using Models Incorporating Bending Stiffness," Filed Jul. 28, 2009, 4 pgs., 4 pgs.
"U.S. Non-Final Office Action", dated Oct. 3, 2014, U.S. Appl. No. 13/524,158, "Modular Geosteerinq Tool Assembly," filed Jun. 15, 2012, 33 pgs.
"EPO Office Action", dated Nov. 14, 2014, Appl No. 07810315.7, "Method and Apparatus for Building a Tilted Antenna," Filed Jul. 11, 2007, 4 pgs.
"U.S. Non-Final Office Action", dated Dec. 15, 2014, U.S. Appl. No. 13/588,739, "Antenna Coupling Component Measurement Tool Having a Rotating Antenna Configuration," filed Aug. 17, 2012, 7 pgs.
"CA 4th Examiner's Letter", dated Mar. 2, 2015, Appl. No. 2,689,859, "Electromagnetic Wave Resistivity Tool With Tilted Antenna," Filed Jan. 15, 2010, 3 Pgs.
"Non-Final Office Action", dated Jun. 5, 2015, U.S. Appl. No. 13/524,158, "Modular Geosteering Tool Assembly," filed Jun. 15, 2012, 13 Pgs.
"In First Examination Report", dated Nov. 27, 2014, Appl No. 9471/DELNP/2008, "Method and Apparatus for Building a Tilted Antenna," filed Nov. 12, 2008.
"Non-Final_Office_Action", dated Oct. 23, 2015, U.S. Appl. No. 12/689,435, Tool for Azimuthal Resistivity Measurement and Bed Boundary Detection, filed Jan. 19, 2010, 6 pgs.
Barkved, Olav et al., "Valhall Field—Still on Plateau after 20 Years of Production", Barkved, O., Heavey, P., Kielstadli, R., Kleppan, T., & Kristiansen, T. G. (Jan. 1, 2003), Valhall Field—Still on Plateau after 20 Years of Production. Society of Petroleum Engineers. doi:10.2118/83957-MS, 16 pgs.
"U.S. Non-Final Office Action", dated May 3, 2016, U.S. Appl. No. 13/524,158, "Modular Geosteering Tool Assembly", filed Jul. 11, 2006, 8 pgs.
"Non-Final Office Action", dated Sep. 14, 2016, U.S. Appl. No. 15/252,153, "Tool for Azimuthal Resistivity Measurement and Bed Boundary Detection," filed Aug. 30, 2016, 7 pgs.
"Non-Final Office Action", dated Nov. 25, 2016, U.S. Appl. No. 13/524,158, "Modular Geosteering Tool Assembly," filed Jun. 15, 2012, 11 pgs.
"Extended EP Search Report", dated Mar. 16, 2017, Appl. No. 16200956.7, "Method and Apparatus for Building a Tilted Antenna," filed Jul. 11, 2007, 6 pgs.
"Final Office Action", dated Apr. 7, 2017, U.S. Appl. No. 15/252,153, "Tool for Azimuthal Resistivity Measurement and Bed Boundary Detection," filed Aug. 30, 2016, 34 pgs.

FIG. 2
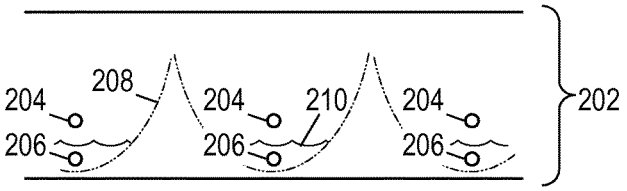
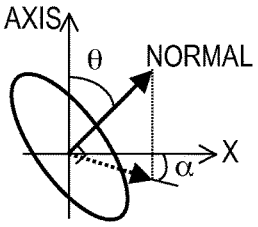
FIG. 3
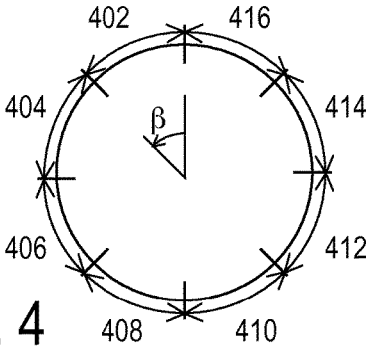
FIG. 4
FIG. 5
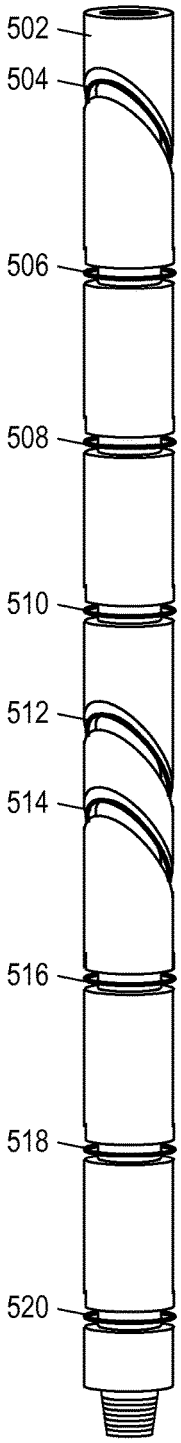
FIG. 6
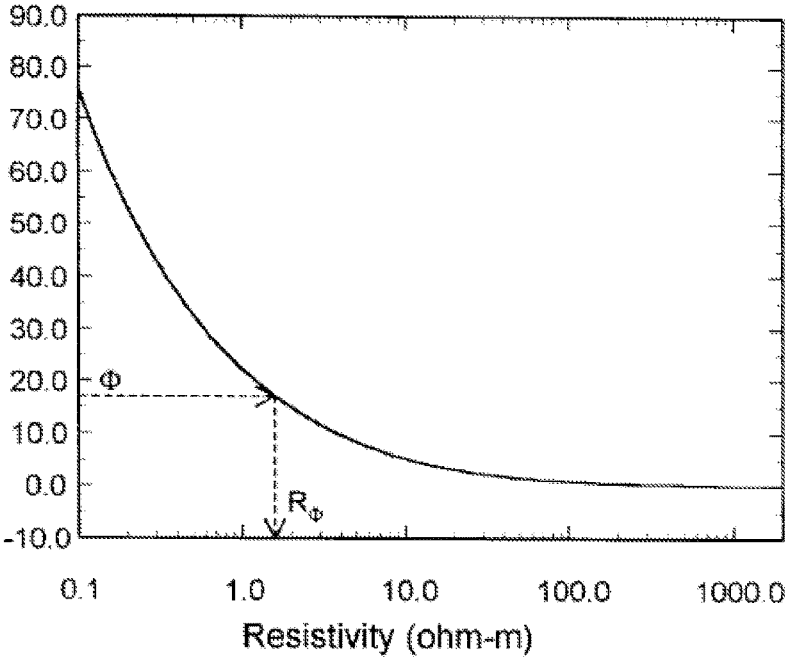

EM-GUIDED DRILLING RELATIVE TO AN EXISTING BOREHOLE

BACKGROUND

The world depends on hydrocarbons to solve many of its energy needs. Consequently, oil field operators strive to produce and sell hydrocarbons as efficiently as possible. Much of the easily obtainable oil has already been produced, so new techniques are being developed to extract less accessible hydrocarbons. One such technique is steam-assisted gravity drainage ("SAGD") as described in U.S. Pat. No. 6,257,334, "Steam-Assisted Gravity Drainage Heavy Oil Recovery Process". SAGD uses a pair of vertically-spaced, horizontal wells about less than 10 meters apart.

In operation, the upper well is used to inject steam into the formation. The steam heats the heavy oil, thereby increasing its mobility. The warm oil (and condensed steam) drains into the lower well and flows to the surface. A throttling technique is used to keep the lower well fully immersed in liquid, thereby "trapping" the steam in the formation. If the liquid level falls too low, the steam flows directly from the upper well to the lower well, reducing the heating efficiency and inhibiting production of the heavy oil. Such a direct flow (termed a "short circuit") greatly reduces the pressure gradient that drives fluid into the lower well.

Short circuit vulnerability can be reduced by carefully maintaining the inter-well spacing, i.e., by making the wells as parallel as possible. Points where the inter-well spacing is smaller than average provide lower resistance to short circuit flows. In percentage terms, the significance of variations in borehole spacing is reduced at larger inter-well spacings. Hence, in the absence of precision drilling techniques, the inter-well spacing is kept larger than would otherwise be desirable to reduce short circuit vulnerability.

BRIEF DESCRIPTION OF THE DRAWINGS

A better understanding of the various disclosed embodiments can be obtained when the following detailed description is considered in conjunction with the accompanying drawings, in which:

FIG. 2 shows an illustrative reservoir in which steam-assisted gravity drainage (SAGD) is employed;

FIG. 3 shows a coordinate system for specifying antenna tilt;

FIG. 4 shows a borehole cross-section divided into azimuthal sectors;

FIG. 5 shows an illustrative electromagnetic logging tool suitable for guided drilling;

FIG. 6 shows an illustrative graph of phase shift as a function of formation resistivity;

Figure 1:
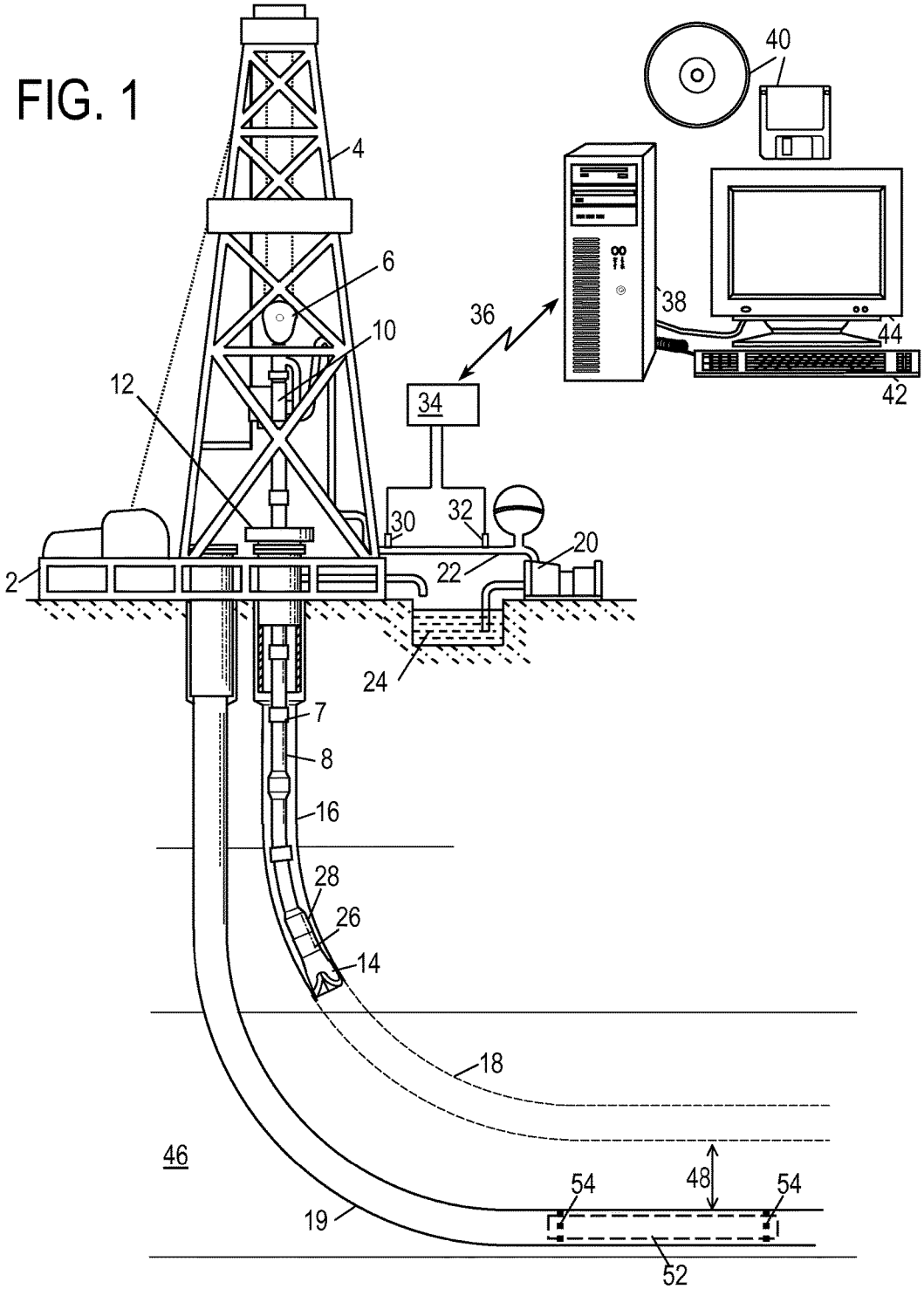
FIG. 1 shows an illustrative drilling environment in which electromagnetically-guided drilling may be employed.

While the invention is susceptible to various modifications and alternative forms, specific embodiments thereof are shown by way of example in the drawings and will herein be described in detail. It should be understood, however, that the drawings and detailed description are not intended to limit the invention to the particular form disclosed, but on the contrary, the intention is to cover all modifications, equivalents and alternatives falling within the spirit and scope of the present invention as defined by the appended claims.

DETAILED DESCRIPTION

The issues identified in the background are at least partly addressed by the use of electromagnetically-guided (EM-guided) drilling relative to an existing borehole. A tilted-antenna tool provides azimuthally-sensitive measurements of resistivity that can be used to detect distance and direction to an existing borehole. Such measurements can be made at multiple investigation depths to provide unprecedented distance measurement accuracy at ranges up to six meters or more from a nearby borehole. (Depending on the steering mechanism, the distance can be maintained constant to within 0.5 meters.) With such measurements, guided drilling of closely-spaced wells can be accomplished without undue vulnerability to short circuits.

The disclosed EM-guidance systems and methods are best understood in the context of the larger systems in which they operate. Accordingly, an illustrative geosteering environment is shown in FIG. 1. A drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As bit 14 rotates, it creates a borehole 16 that passes through various formations.

The drill hit 14 is just one piece of a bottom-hole assembly that includes one or more drill collars (thick-walled steel pipe) to provide weight and rigidity to aid the drilling process. Some of these drill collars include logging instruments to gather measurements of various drilling parameters such as position, orientation, weight-on-bit, borehole diameter, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. In some embodiments, the tool face and hole inclination angles are calculated from the accelerometer sensor output. The magnetometer sensor outputs are used to calculate the compass direction.

The bottom-hole assembly further includes a tool 26 to gather measurements of for nation properties from which nearby borehole detection signals can be derived. Using these measurements in combination with the tool orientation measurements, the driller can steer the drill bit 14 along a desired path 18 in formation 46 using any one of various suitable directional drilling systems, including steering vanes, a "bent sub", and a rotary steerable system to steer the drill bit along a desired path 18 parallel to an existing borehole. For precision steering, the steering vanes may be the most desirable steering mechanism. The steering mechanism can be alternatively controlled downhole, with a downhole controller programmed to follow the existing borehole 19 at a predetermined distance 48 and position (e.g., directly above or below the existing borehole).

A pump 20 circulates drilling fluid through a feed pipe 22 to top drive 10, downhole through the interior of drill string 8, through orifices in drill bit 14, back to the surface via the annulus around drill string 8, and into a retention pit 24. The drilling fluid transports cuttings from the borehole into the pit 24 and aids in maintaining the borehole integrity. Moreover, a telemetry sub 28 coupled to the downhole tools 26 can transmit telemetry data to the surface via mud pulse telemetry. A transmitter in the telemetry sub 28 modulates a resistance to drilling, fluid flow to generate pressure pulses that propagate along the fluid stream at the speed of sound to the surface. One or more pressure transducers 30, 32 convert the pressure signal into electrical signal(s) for a signal digitizer 34. Note that other forms of telemetry exist and may be used to communicate signals from downhole to the digitizer. Such telemetry may employ acoustic telemetry, electromagnetic telemetry, or telemetry via wired drillpipe.

The digitizer 34 supplies a digital form of the telemetry signals via a communications link 36 to a computer 38 or some other form of a data processing device. Computer 38 operates in accordance with software (which may be stored on information storage media 40) and user input via an input device 42 to process and decode the received signals. The resulting telemetry data may be further analyzed and processed by computer 38 to generate a display of useful information on a computer monitor 44 or some other form of a display device. For example, a driller could employ this system to obtain and monitor drilling parameters, formation properties, and the path of the borehole relative to the existing borehole 19 and any detected formation boundaries. A downlink channel can then be used to transmit steering commands from the surface to the bottom-hole assembly.

With such a drilling system it becomes possible to drill an arrangement of boreholes that enable efficient production of heavy oils from a formation using a steam-assisted gravity drainage (SAGD) technique. FIG. 2 shows a formation 202 having vertically-spaced pairs of boreholes (shown end-on in this view), each pair consisting of an injection well 204 and a production well 206. Steam is injected into the formation where it condenses, heating the heavy oil around and above the wells. With its mobility increased, the heavy oil drains downward, along with the condensate to form a liquid pool 210 that is produced via well 206. The unheated heavy oil eventually acquires the profile 208, often necessitating the use of multiple well pairs to efficiently access the oil reserves. The ability to routinely drill precisely-spaced boreholes is expected to greatly enhance the value of such heavy oil reserves.

In at least some embodiments, the nearby borehole detection tool 26 employs tilted antennas for electromagnetic resistivity measurements such as those disclosed by Michael Bittar in U.S. Pat. No. 7,265,552. As shown in FIG. 3, the orientation of such tilted antennas can be specified in terms of a tilt angle $\theta$ and a rotational angle $\alpha$ The tilt angle is the angle between the tool axis and the magnetic moment of the loop antenna. The rotational angle $\alpha$ is the angle between the tool face scribe line and the projection of the normal vector. As the tool rotates, the tilted antenna(s) gain measurement sensitivity in different azimuthal directions from the borehole, and these measurements can be made as a function of the azimuthal angle. FIG. 4 shows a borehole circumference divided into azimuthal sectors 402-416, corresponding to ranges of azimuthal angles. The azimuthal angle $\beta$ is defined relative to the "high-side" of the borehole (or, in substantially vertical wells, relative to the north-side of the borehole). When the tool is centered in the borehole, the azimuthal angle $\beta$ preferably corresponds to the position of the tool face scribe line. In some embodiments, angular corrections are applied to the rotational orientations of de-centralized tools when associating measurements with an azimuthal sector. Though eight sectors are shown in the figure, the actual number of sectors may vary between 4 and the highest resolution the tool will support.

Referring now to FIG. 5, an illustrative borehole detection tool 502 is shown. The tool 502 is provided with one or more regions of reduced diameter for suspending a wire coil. The wire coil is placed in the region and spaced away from the tool surface by a constant distance. To mechanically support and protect the coil, a non-conductive filler material (not shown) such as epoxy, rubber, fiberglass, or ceramics may be used to fill in the reduced diameter regions. The transmitter and receiver coils may comprise as little as one loop of wire, although more loops may provide additional signal power. The distance between the coils and the tool surface is preferably in the range from 1/16 inch to 3/4 inch, but may be larger.

The illustrated tool 502 has six coaxial transmitters 506 (T5), 508 (T3), 510 (T1), 516 (T2), 518 (T4), and 520 (T6), meaning that the axes of these transmitters coincide with the longitudinal axis of the tool. In addition, tool 502 has three tilted receiver antennas 504 (R3), 512 (R1), and 514 (R2). The term "tilted" indicates that the magnetic moment of the coil is not parallel to the longitudinal tool axis. The spacing of the antennas may be stated in terms of a length parameter x, which in some embodiments is about 16 inches. Measuring along the longitudinal axis from a midpoint between the centers of receiver antennas 512 and 514, transmitters 510 and 516 are located at ±1x, transmitters 508 and 518 are located at ±2x, and transmitters 506 and 520 are located at ±3x. The receiver antennas 512 and 514 may be located at ±x/4. In addition, a receiver antenna 504 may be located at plus or minus 4x.

The length parameter and spacing coefficients may be varied as desired to provide greater or lesser depths of investigation, higher spatial resolution, or higher signal to noise ratio. However, with the illustrated spacing, symmetric resistivity measurements can be made with 1x, 2x, and 3x spacing between the tilted receiver antenna pair 512, 514, and the respective transmitter pairs 510 (T1), 516 (T2); 508 (T3), 518 (T4); and 506 (T5), 520 (T6). In addition, asymmetric resistivity measurements can be made with 1x, 2x, 3x, 5x, 6x, and 7x spacing between the tilted receiver antenna 504 and the respective transmitters 506, 508, 510, 516, 518, and 520. This spacing configuration provides tool 502 with some versatility, enabling it to perform deep (but asymmetric) measurements for nearby borehole detection and symmetric measurements for accurate azimuthal resistivity determination.

In some contemplated embodiments, the transmitters may be tilted and the receivers may be coaxial, while in other embodiments, both the transmitters and receivers are tilted, though preferably the transmitter and receiver tilt angles are different. Moreover, the roles of transmitter and receiver may be interchanged while preserving the usefulness of the measurements made by the tool. In operation, each of the transmitters is energized in turn, and the phase and amplitude of the resulting voltage induced in each of the receiver coils are measured. From these measurements, or a combination of these measurements, the formation resistivity can be determined as a function of azimuthal angle and radial distance. Moreover, the distance and direction to nearby boreholes can be measured.

For asymmetric resistivity measurements, receiver 504 detects a signal responsive to the firing of each transmitter. The tool 502 measures the phase shift and attenuation of the received signal relative to the phase and amplitude of the transmit signal. The larger transmitter-receiver spacings provide measurements over larger formation volumes, yielding deeper depths of investigation. Tool 502 can also employ multiple transmit signal frequencies to further increase the number of depths of investigation. FIG. 6 shows an illustrative phase shift dependence on formation resistivity. The signal attenuation exhibits a similar dependence. With attenuation and phase shift measurements at multiple azimuthal orientations and multiple depths of investigation, tool 502 can compile a three-dimensional view of the resistivity profile of the formation around the borehole as the drilling progresses.

For symmetric resistivity measurements, receivers 512, 514 each detect signals responsive to the firing of each transmitter. The tool 502 measures the phase shift and attenuation between the received signals and combines the measurements from the equally-spaced transmitters to provide robust compensation for temperature drift and other electronic circuit imperfections. The degree of compensation can be measured and, if desired, applied to the asymmetric resistivity measurements. Otherwise, the analysis and usage of the symmetric measurements is similar to the asymmetric measurements.

In the illustrated embodiment of FIG. 5, the receiver coils are tilted with a 45° angle between the normal and the tool axis. Angles other than 45° may be employed, and in some contemplated embodiments, the receiver coils are tilted at unequal angles or are tilted in different azimuthal directions. The tool 502 is rotated during the drilling process, so that resistivity measurements can be made with the tilted coils oriented in different azimuthal directions. These measurements may be correlated with tool orientation measurements to enable detection of borehole distances and directions.

Figure 7A:
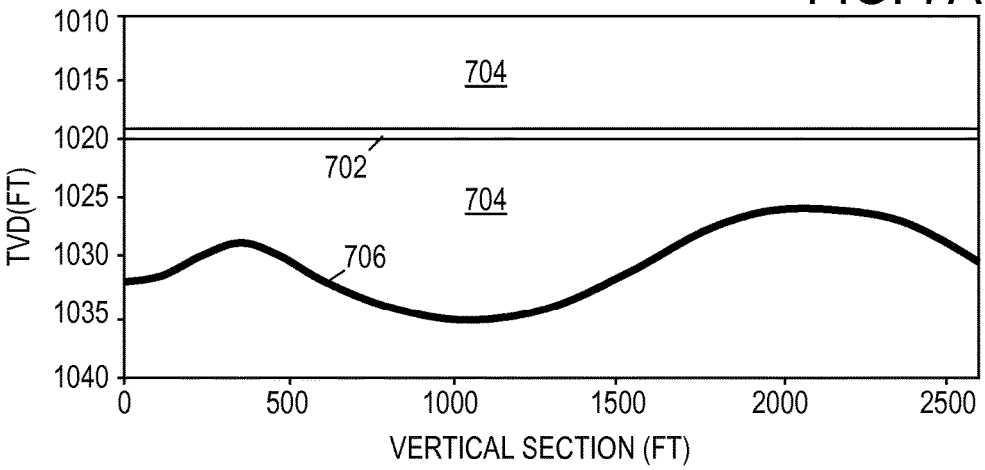
FIG. 7A shows a new borehole path relative to an existing borehole.
Figure 7B:
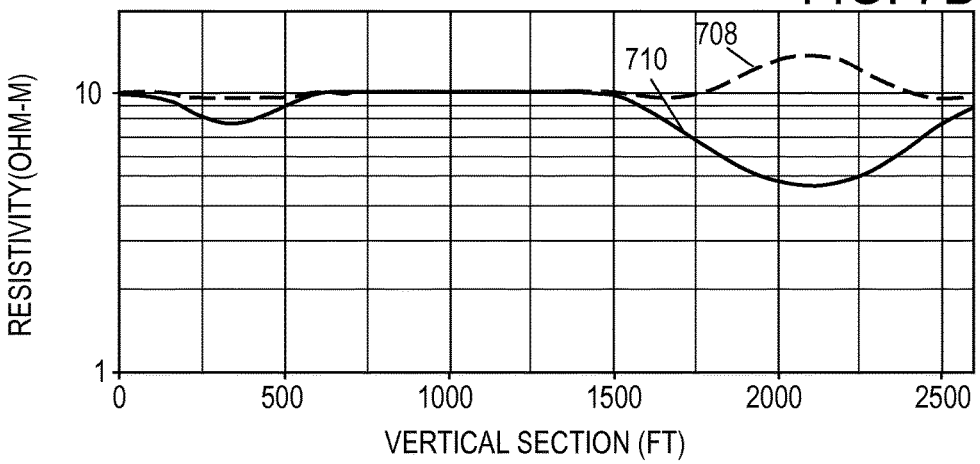
FIG. 7B shows a modeled range of resistivity measurements.

FIG. 7A shows a hypothetical 12 inch borehole 702 passing horizontally through a formation 704 at a depth of 1020 feet. The formation is assumed to have a resistivity of 10 ohm-m, while the borehole is assumed to have a resistivity of less than 1 ohm-m. Simulations have been run for a tilted-antenna tool passing along a nearby path 706 through the formation. Path 706 has an average depth of 1030 feet, but it has a first deviation of +2 and −2 feet, followed by a deviation of +5 and −5 feet. With a transmitter-receiver spacing of 112 inches and a signal frequency of 125 kHz, the resulting formation resistivity measurements are shown in FIG. 7B. Curve 710 shows the resistivity measured while the tool is rotated toward borehole 702, and curve 708 shows the resistivity measured at the opposite orientation. In this hypothetical example, the detection range is about 10 feet. When the tool moves beyond this distance, the borehole is not detected. However, when the distance falls below this value the distance and direction of borehole 702 is readily determinable.

Figure 7C:
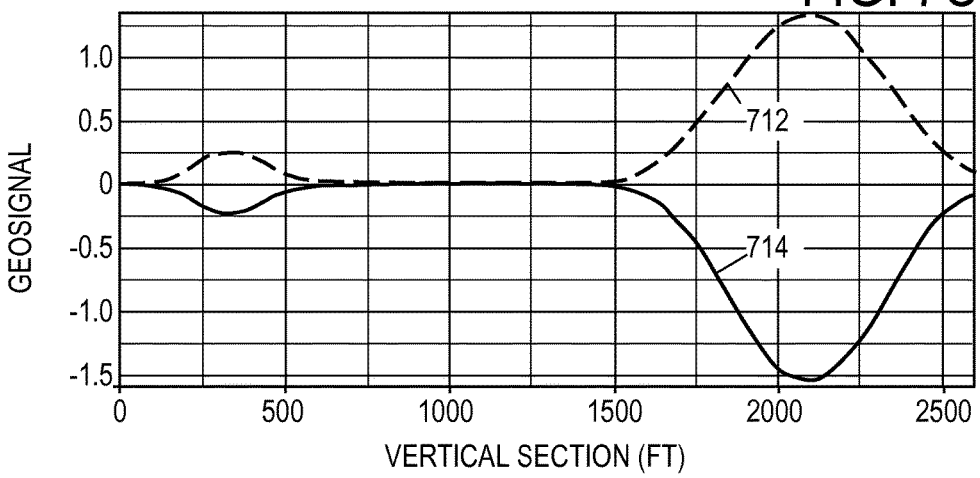
FIG. 7C shows a modeled geosteering signal.

FIG. 7C shows a geosteering signal ("geosignal") calculated by taking a difference between the azimuthal attenuation measurement (in dB) and an average attenuation measurement (in dB) over all azimuths. Curve 714 shows the geosignal when the tool is oriented toward borehole 702 and curve 712 shows the geosignal for the opposite orientation. When the tool is within 10 feet, the geosignal varies with tool rotation, reaching a minimum when the tool is oriented towards the nearby borehole. The magnitude of the variation is indicative of the distance to the borehole. Greater range may be expected in formations having higher resistivity, if longer transmitter-receiver antenna spacings are employed, and/or if lower frequencies are employed. Greater sensitivity to distance is expected with shorter transmitter-receiver antenna spacings and/or higher frequencies. Thus it is desirable to have variable spacing and/or frequencies. Note that most reservoirs of interest are expected to have much higher formation resistivities. More detail regarding suitable methods for calculating a geosteering signal can be found in U.S. Patent Application 60/821,988.

Figure 7D:
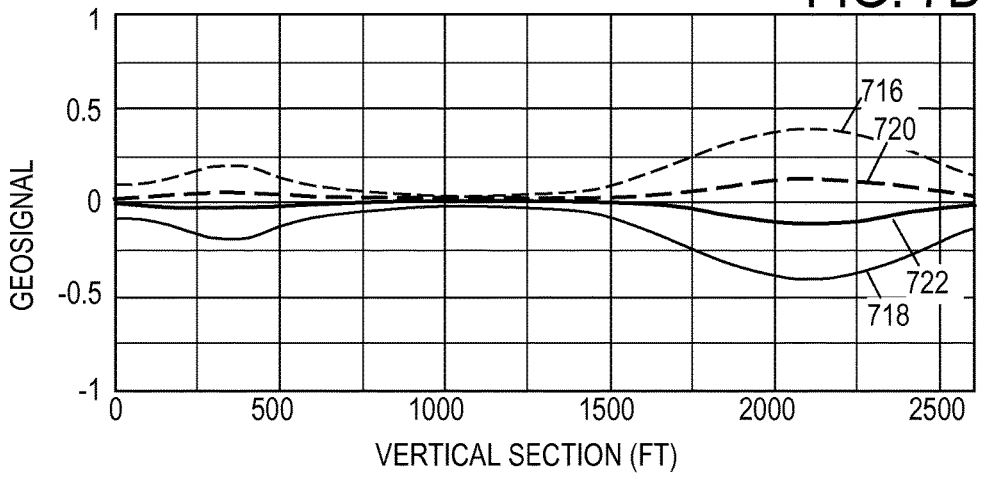
FIGS. 7D-7F show modeled geosteering signals for different frequencies and antenna spacings.
Figure 7E:
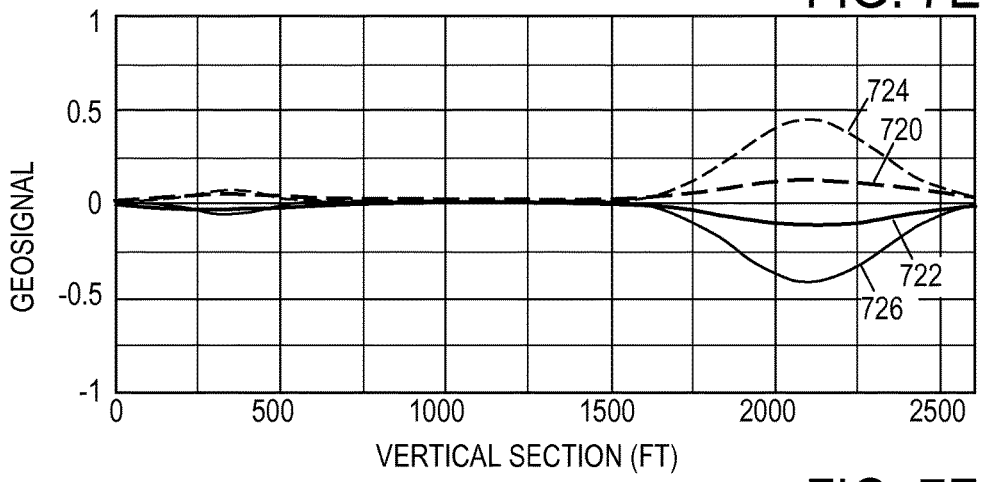
Figure 7F:
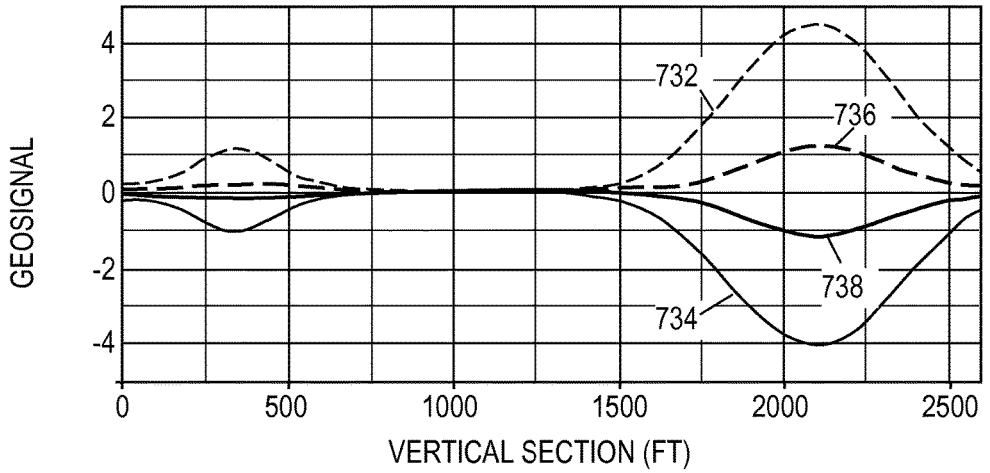

The effects different tool parameters on the geosteering signal are illustrated in FIGS. 7D-7F, using the same hypothetical configuration of FIG. 7A. In FIG. 7D, curves 716 and 718 are attenuation-based geosteering signals obtained using an 112-inch transmitter-receiver spacing with a 125 kHz signal frequency. Curve 718 is obtained when the tool is oriented toward borehole 702, and curve 716 is obtained when the tool is oriented away from the borehole. These curves can be compared with curves 720 and 722, which are obtained with the same frequency, but with a 48-inch transmitter-receiver spacing, showing the greater range of the longer-spaced antenna configuration.

In FIG. 7E, curves 720 and 722 are repeated for comparison with curves 724 and 726, which are obtained with a 48-inch transmitter-receiver spacing and a 500 kHz signal frequency. Clearly, the higher signal frequency also provides an increased detection range. In this and the previous figure, the geosignal curves are attenuation-based, i.e., determined by subtracting the average attenuation from the azimuthally-sensitive attenuation measurement. In FIG. 7F, however, the geosignal is phase-based, i.e., determined by subtracting the average phase shift from the azimuthally-sensitive phase shift measurement. Curves 732 and 734 are obtained with a 112-inch spacing and a signal frequency of 125 kHz. Curves 736 and 738 are obtained with the same signal frequency, but a 48-inch spacing. In both cases, the lower curve is obtained when the tool is oriented toward the nearby borehole, and the upper curve is obtained when the tool is oriented away.

Figure 8:
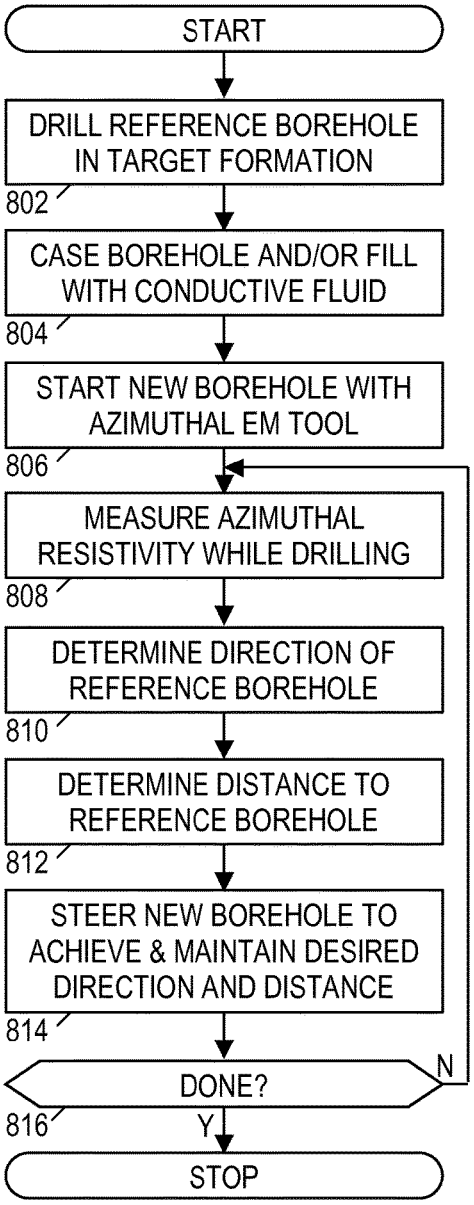
FIG. 8 shows a flow diagram of an illustrative EM-guided drilling method.

FIG. 8 is a flowchart of an illustrative method for drilling closely-spaced parallel boreholes. Beginning with block 802, a driller drills the initial ("reference") borehole in the target formation. Much of the time, the initial borehole will be placed as near the bottom of the oil-bearing bed as feasible, and will later be used as the producing borehole. Though deviations from a straight path may be provided to follow the bed boundary, the path of the reference borehole in most applications will be maintained as straight as possible to simplify parallel drilling.

In block 804, the reference borehole is given a contrasting resistivity from the surrounding formation. Because oil-producing formations tend to be highly resistive, this operation may involve lining the reference borehole with an electrically-conductive well casing. As an alternative, the reference borehole may be filled with a conductive fluid such as a water-based drilling fluid having mobile ions.

In block 806, a driller starts drilling a new borehole with a drill string that includes an azimuthally-sensitive electromagnetic tool and a steering mechanism for controlling drilling direction. The new borehole may be a separate well as shown in FIG. 1, or it may be a branch well initiated from part way along the initial well. In block 808, the tool gathers azimuthally-sensitive measurements indicative of formation resistivity. These measurements can be used directly or indirectly to determine the direction of the reference borehole in block 810. In some embodiments, the direction is the azimuthal angle associated with the minimum resistivity measurement or with an extremum in the geosteering signal. Such knowledge enables ready determination of the desired drilling direction if an increase or decrease in inter-well spacing is desired.

In block 812, the distance to the reference borehole is determined. This distance may be determined as a function of average formation resistivity and the magnitude of the sinusoidal variation that the measurement exhibits versus azimuthal angle. The tool's engineers may calibrate the tool and determine a lookup table from which distance measurements can be determined. Alternatively, a more complete processing of the three-dimensional dependence of resistivity may be employed to determine the distance to the reference borehole. However, in some embodiments, the magnitude of the geosteering signal may be employed as a rough distance indicator, and the bit may be steered to maintain this magnitude at a relatively constant value rather than determining an absolute distance measurement.

In block 814, the drilling direction is adjusted in response to the direction and distance determinations to keep the inter-well distance and orientation as consistent as possible. In some embodiments, a downhole processor in the bottom hole assembly performs an automatic determination of direction and distance and automatically adjusts the steering mechanism to establish a constant vertical spacing which can be set and adjusted from the surface. In other embodiments, the driller monitors the direction and distance measurements at the surface and sends steering commands to the bottom hole assembly. As long as the drilling continues, block 816 indicates that blocks 808-814 of the process are repeated.

Figure 9:
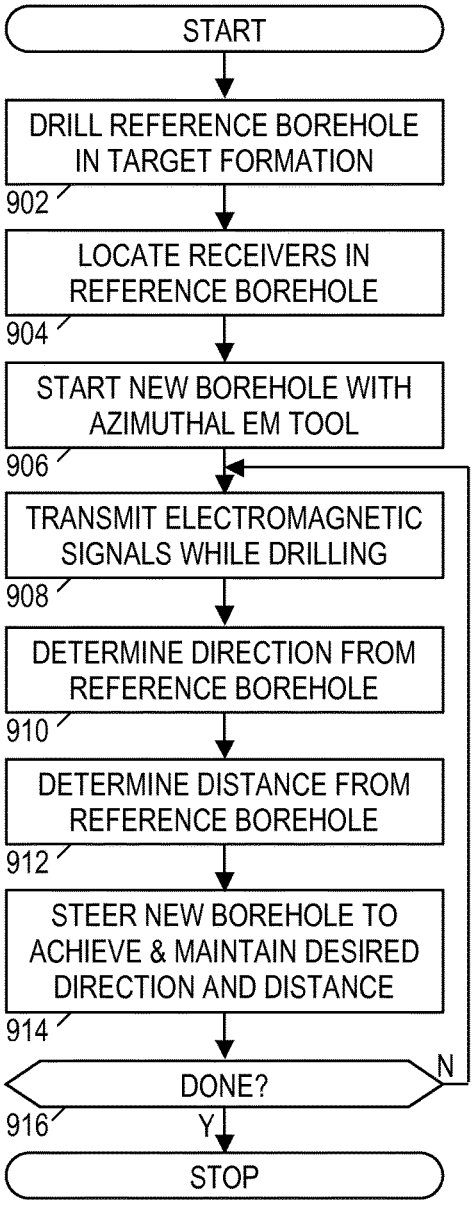
FIG. 9 is a flowchart of an alternative method for drilling closely-spaced parallel boreholes.

FIG. 9 is a flowchart of an alternative method for drilling closely-spaced parallel boreholes. As before, a driller begins by drilling a reference borehole in the target formation (block 902). In block 904, an array of receivers is placed in the reference borehole. (Referring momentarily to FIG. 1, a receiver tool 52 is located in reference borehole 19. The illustrated tool 52 includes two co-axial antennas 54, but additional receivers may be employed.) In some embodiments, the receiver array is essentially fixed and non-rotating. In such embodiments, the receiver spacing is chosen to ensure that at least one receiver is able to detect signals from the transmitter at all points in the region of interest, and the extent of the receiver array is designed to cover the length of the reference borehole in the region of interest. In other embodiments, the receiver array is moved along the reference borehole as the drilling progresses. In such embodiments, the extent of the receiver array can be substantially reduced.

In block 906, the driller starts drilling a new borehole with a drill string that includes at least one tilted-antenna transmitter and a steering mechanism for controlling drilling direction. In block 908, the tool transmits electromagnetic signals with an azimuthally-varying directivity as the tool rotates. The tool orientation information may be encoded into the transmit signals, or alternatively communicated to the surface. Where multiple transmit antennas are employed, the transmitters may operate at different frequencies and/or fire at different times. If desired, transmitter identification information may also be encoded into the transmit signal.

In block 910, at least one of the receive antennas in the reference borehole detects the transmit signal(s) and measures amplitude variation and phase shift as a function of time. The timing of the sinusoidal variation can be combined with transmitter orientation information (either at the surface or using the information encoded into the transmit signal) to determine the relative direction between the transmitter and the receivers in the reference borehole. Moreover, if multiple receive antennas detect the signal, array processing techniques may be used to triangulate the direction of the transmitter relative to the receiver array. Some embodiments include azimuthally-sensitive receive antennas to improve direction-detection capability. For example, a triad of linearly-independent receive antennas can be located at each receiving position in the receiver array.

In block 912, the distance between the transmitter and the receiver array in the reference borehole is determined. This distance may be determined as a function of average signal strength and the magnitude of the sinusoidal variation that the measurement exhibits versus azimuthal angle. Alternatively, a more complete processing of the signals from each of the transmitters to each of the receivers may be employed to determine the distance to the reference borehole.

In block 914, the drilling direction is adjusted in response to the direction and distance determinations to keep the inter-well distance and orientation as consistent as possible. In some embodiments, the driller monitors the direction and distance measurements at the surface and sends steering commands to the bottom hole assembly. As long as the drilling continues, block 916 indicates that blocks 908-914 of the process are repeated. Re-positioning of the receiver array within the reference borehole may be needed periodically.

Note that the roles of transmitters and receivers can be interchanged. In some embodiments, a set of two or more transmitters is located in the reference borehole and a set of azimuthally-sensitive receive antennas is provided in the bottom hole assembly. In this alternative configuration, the downhole processor may be programmed with limited autosteering capability based on the measurements of distance and direction from the reference borehole as represented by a line connecting the transmitters. Autosteering can be performed using any standard feedback technique for minimizing the error between programmed and measured distance and direction values, subject to the constraints imposed by the steering dynamics of the drillstring.

In many situations, it may not be necessary to perform explicit distance and direction calculations. For example, the deep resistivity or geosignal values may be converted to pixel colors or intensities and displayed as a function of borehole azimuth and distance along the borehole axis. Assuming the reference borehole is within detection range, the reference borehole will appear as a bright (or, if preferred, a dark) band in the image. The color or brightness of the band indicates the distance to the reference borehole, and the position of the band indicates the direction to the reference borehole. Thus, by viewing such an image, a driller can determine in a very intuitive manner whether the new borehole is drifting from the desired course and he or she can quickly initiate corrective action. For example, if the band becomes dimmer, the driller can steer towards the reference borehole. Conversely, if the band increases in brightness, the driller can steer away from the reference borehole. If the band deviates from its desired position directly above or below the existing borehole, the driller can steer laterally to re-establish the desired directional relationship between the boreholes.

Numerous variations and modifications will become apparent to those skilled in the art once the above disclosure is fully appreciated. It is intended that the following claims be interpreted to embrace all such variations and modifications.

What is claimed is:

1. A parallel drilling method that comprises:

gathering azimuthally-sensitive measurements of electromagnetic signals while drilling a new borehole near an existing borehole, said measurements being indicative of a formation resistivity; and steering a drill string along a path at a substantially constant distance from the existing borehole, wherein the drill string includes both transmit and receive antennas for making the azimuthally-sensitive measurements, and determining the substantially constant distance based at least in part on the formation resistivity measurements.

2. The method of claim 1, wherein the distance is less than 10 meters and constant to within +/−0.5 meters.

3. The method of claim 1, wherein the new borehole is positioned vertically above or below the existing borehole.

4. The method of claim 1, wherein the existing borehole is cased with a conductive casing.

5. The method of claim 1, wherein a conductive fluid is present within the existing borehole.

6. The method of claim 1, wherein the drill string includes a tool having at least one tilted antenna in the bottom hole assembly.

7. The method of claim 1, wherein the azimuthally-sensitive measurements are indicative of a three-dimensional resistivity profile around the new borehole.

8. The method of claim 1, wherein the azimuthally-sensitive measurements are geosignals indicative of an azimuthal direction towards a conductive object.

9. The method of claim 1, wherein said steering includes:

processing the azimuthally-sensitive measurements downhole to determine control signals for steering the drill string in a manner that minimizes a difference between measured and programmed distance values.

10. A parallel drilling system that comprises:

a steerable drill string that includes a tool having at least one tilted transmitter antenna, wherein the tool comprises at least one receive antenna, gathers formation resistivity measurements acquired using the receive antenna and determines distance to an existing borehole based at least in part on the formation resistivity measurements.

11. The system of claim 10, wherein the drill string includes a downhole processor that determines steering control signals to direct the drill string along a path parallel to the existing borehole.

12. The system of claim 10, wherein tool determines a signal indicative of a direction to the existing borehole.

13. The system of claim 10, wherein the measurements include measurements of signal attenuation as a function of azimuthal angle.

14. The system of claim 10, wherein the measurements include measurements of signal phase shift as a function of azimuthal angle.

15. The system of claim 10, further including an array of at least two receivers in the existing borehole.

16. The system of claim 10, further comprising a surface computer that enables a driller to monitor said distance and responsively steer the drill string along a path at a constant distance and direction from the existing borehole.

17. A parallel drilling method that comprises:

transmitting an azimuthally non-uniform electromagnetic signal from a source in a drill string while creating a new borehole; and detecting the signal with at least two receivers in an existing borehole to determine distance from the existing borehole to the source, said signal being indicative of a formation resistivity and said distance being determined based at least in part on said formation resistivity.

18. The method of claim 17, further comprising steering the drill string to direct the new borehole along a path that parallels the existing borehole.

19. The method of claim 17, wherein the source includes at least one tilted transmitter antenna.

20. The method of claim 19, wherein the tilted transmitter antenna rotates to transmit the signal in different azimuthal directions.

21. The method of claim 20, wherein the signal includes information regarding the azimuthal orientation of the source.

22. The method of claim 17, further comprising determining a direction between the existing borehole and the source.

23. The method of claim 22, further comprising communicating the distance and direction measurement to a surface computer.

24. The method of claim 23, further comprising displaying a representation of the existing borehole relative to the new borehole to enable the driller to steer the new borehole parallel to the existing borehole.

* * * * *